US011543758B2

(12) United States Patent
Kamijo et al.

(10) Patent No.: US 11,543,758 B2
(45) Date of Patent: Jan. 3, 2023

(54) UNIT AND IMAGE FORMING APPARATUS FOR FIXING A TONER IMAGE WITH A DEVELOPER INCLUDING A BRILLIANT TONER CONTAINING A FLAT BRILLIANT PIGMENT

(71) Applicant: FUJIFILM Business Innovation Corp., Tokyo (JP)

(72) Inventors: Yukiko Kamijo, Minamiashigara (JP); Hideaki Ohara, Ebina (JP); Kenji Omori, Ebina (JP); Junko Yamasaki, Ebina (JP); Daisuke Nakashima, Minamiashigara (JP); Yuka Ishihara, Minamiashigara (JP); Hitoshi Komuro, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/409,345

(22) Filed: Aug. 23, 2021

(65) Prior Publication Data

US 2022/0244653 A1 Aug. 4, 2022

(30) Foreign Application Priority Data

Feb. 2, 2021 (JP) ..... JP2021-015151

(51) Int. Cl.
*G03G 15/20* (2006.01)
*G03G 9/087* (2006.01)
(Continued)

(52) U.S. Cl.
CPC ..... *G03G 9/08755* (2013.01); *G03G 9/0819* (2013.01); *G03G 9/0821* (2013.01);
(Continued)

(58) Field of Classification Search
CPC ..... G03G 9/0819; G03G 9/0821; G03G 9/08755; G03G 9/0902; G03G 15/2057; G03G 15/2064; G03G 2215/2032
See application file for complete search history.

(56) References Cited

U.S. PATENT DOCUMENTS 5,985,503 A * 11/1999 de Beeck ..... G03G 7/008 430/125.33
2014/0023964 A1 1/2014 Hirai et al.
(Continued)

FOREIGN PATENT DOCUMENTS

EP 1550919 A1 7/2005
JP 2017-62413 A 3/2017

OTHER PUBLICATIONS

Communication dated Mar. 1, 2022 by the European Patent Office in European Patent Application No. 21195688.3.

*Primary Examiner* — Hoang X Ngo
(74) *Attorney, Agent, or Firm* — Sughrue Mion, PLLC

(57) ABSTRACT

A unit includes: a developing device configured to develop an electrostatic charge image that is formed on a surface of an image carrier, as a toner image with a developer including a brilliant toner containing a flat brilliant pigment, the developer being accommodated in the developing device; and a fixing device configured to fix the toner image onto a surface of a recording medium at a fixing temperature of 130° C. or higher and 230° C. or lower that includes a fixing belt, a first roller and a second roller that are disposed inside the fixing belt and support the fixing belt while applying tension to the fixing belt, and a pressure roller, the first roller and the pressure roller sandwiching the fixing belt to form a nip portion.

19 Claims, 3 Drawing Sheets

(51) Int. Cl.
*G03G 9/08* (2006.01)
*G03G 9/09* (2006.01)

(52) U.S. Cl.
CPC ..... *G03G 9/0902* (2013.01); *G03G 15/2057* (2013.01); *G03G 15/2064* (2013.01); *G03G 2215/2032* (2013.01)

(56) References Cited

U.S. PATENT DOCUMENTS

| | | | | |
|---|---|---|---|---|
| 2015/0268570 | A1* | 9/2015 | Sakai ..... | G03G 9/0902<br>430/105 |
| 2016/0216626 | A1 | 7/2016 | Taguchi et al. | |
| 2017/0090318 | A1 | 3/2017 | Sugitate et al. | |
| 2018/0356756 | A1 | 12/2018 | Takano et al. | |

* cited by examiner

UNIT AND IMAGE FORMING APPARATUS FOR FIXING A TONER IMAGE WITH A DEVELOPER INCLUDING A BRILLIANT TONER CONTAINING A FLAT BRILLIANT PIGMENT

CROSS-REFERENCE TO RELATED APPLICATIONS

This application is based on and claims priority under 35 USC 119 from Japanese Patent Application No. 2021-015151 filed on Feb. 2, 2021.

BACKGROUND

Technical Field

The present disclosure relates to a unit and an image forming apparatus.

Related Art

In an image forming apparatus (a copying machine, a facsimile machine, a printer, or the like) using an electrophotographic process, a toner image formed on a surface of an image carrier is transferred to a surface of a recording medium and fixed on the recording medium to form an image.

In recent years, the use of a brilliant toner containing a brilliant pigment has been studied for the purpose of forming an image having brilliance such as metallic luster.

For example, JP-A-2017-062413 discloses "a brilliant toner containing a brilliant pigment, an organic pigment, a binder resin, a release agent, and an external additive, in which a content of a toluene-insoluble component other than the brilliant pigment and the external additive is 8 mass % or more and 40 mass % or less".

SUMMARY

The brilliance of an image formed of the brilliant toner is exhibited by parallelizing the brilliant pigment to a surface of a recording medium when a toner image is fixed to a recording medium.

However, the brilliance may be reduced when a brilliant image formed of brilliant toner is formed by a fixing device (hereinafter, also referred to as a "specific fixing device") including a fixing belt, a first roller and a second roller that are disposed inside the fixing belt and support the fixing belt while applying tension to the fixing belt, and a pressure roller, in which the first roller and the pressure roller sandwich the fixing belt to form a nip portion.

Aspects of non-limiting embodiments of the present disclosure relate to a unit for forming a brilliant image with high brilliance formed of brilliant toner as compared with a case where in a unit including a developing device that accommodates brilliant toner, and a specific fixing device, a fixing temperature of the fixing device is lower than 130° C.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a unit including:

a developing device configured to develop an electrostatic charge image that is formed on a surface of an image carrier, as a toner image with a developer including a brilliant toner containing a flat brilliant pigment, the developer being accommodated in the developing device; and a fixing device configured to fix the toner image onto a surface of a recording medium at a fixing temperature of 130° C. or higher and 230° C. or lower that includes a fixing belt, a first roller and a second roller that are disposed inside the fixing belt and support the fixing belt while applying tension to the fixing belt, and a pressure roller, the first roller and the pressure roller sandwiching the fixing belt to form a nip portion.

BRIEF DESCRIPTIONS OF THE DRAWINGS

Exemplary embodiment(s) of the present invention will be described in detail based on the following figures, wherein.

DETAILED DESCRIPTION

Figure 1:
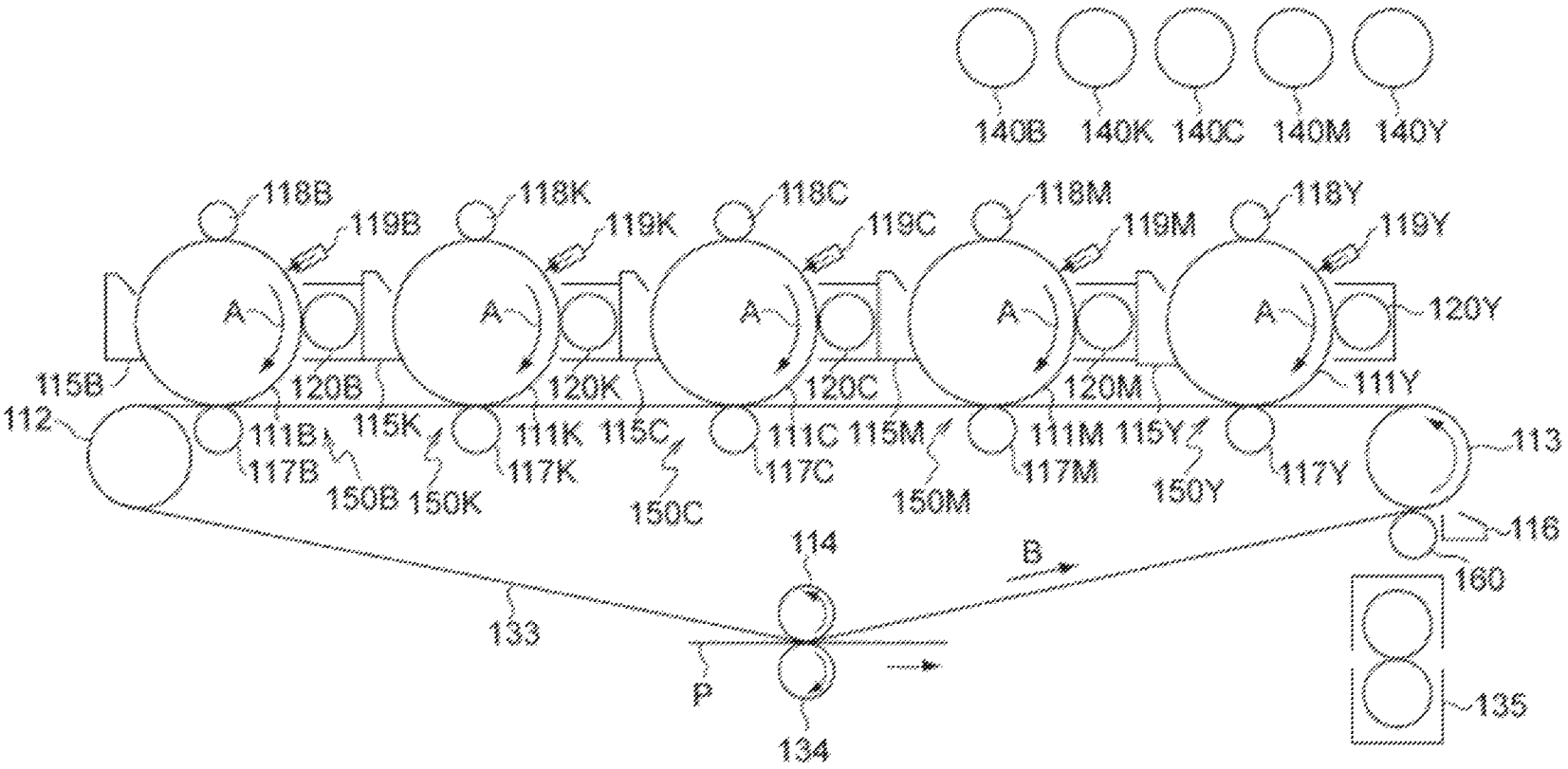
FIG. 1 is a schematic configuration diagram showing an example of an image forming apparatus according to the present exemplary embodiment.

Hereinafter, the present exemplary embodiment which is an example of the present disclosure will be described. These descriptions and Examples are merely examples of the exemplary embodiment, and do not limit the scope of the present disclosure.

In the numerical range described in stages in the present exemplary embodiment, an upper limit or a lower limit described in one numerical range may be replaced with an upper limit or a lower limit of the numerical range described in other stages. In addition, in the numerical range described in the present exemplary embodiment, the upper limit or the lower limit of the numerical range may be replaced with values shown in Examples.

In the present exemplary embodiment, the term "step" indicates not only an independent step, and even when a step cannot be clearly distinguished from other steps, this step is included in the term "step" as long as the intended purpose of the step is achieved.

In the present exemplary embodiment, when an exemplary embodiment is described with reference to the drawings, the configuration of the exemplary embodiment is not limited to the configuration shown in the drawings. In addition, the sizes of the members in each drawing are conceptual, and the relative size relationship between the members is not limited to the relative size relationship between the members shown in the drawings.

In the present exemplary embodiment, each component may include plural corresponding substances. In the present exemplary embodiment, in a case of referring to the amount of each component in the composition, when there are plural substances corresponding to each component in the composition, unless otherwise specified, it refers to the total amount of the plural substances present in the composition.

[Unit]

A unit according to the present exemplary embodiment includes a developing device configured to develop an electrostatic charge image formed on a surface of an image carrier as a toner image with a developer including a brilliant toner containing a flat brilliant pigment, the developer being accommodated in the developing device, and a fixing device configured to fix a toner image onto a surface of a recording medium at a fixing temperature of 130° C. or higher and 230° C. or lower.

As the fixing device, a fixing device (in other words, a specific fixing device), which includes a fixing belt, a first roller and a second roller that are disposed inside the fixing belt and support the fixing belt while applying tension to the fixing belt, and a pressure roller, in which the first roller and the pressure roller sandwich the fixing belt to form a nip portion, is applied.

In the unit according to the present exemplary embodiment, a brilliant image with high brilliance formed of brilliant toner is formed by the above-described configuration. The reasons are as follows.

The brilliance of an image formed of the brilliant toner is exhibited by parallelizing the brilliant pigment to a surface of a recording medium when a toner image is fixed to a recording medium. That is, the brilliance of the image formed of the brilliant toner is exhibited by orienting the brilliant pigment such that a surface facing a thickness direction of the brilliant pigment is in parallel with the surface of the recording medium at the time of fixing.

However, when a brilliant image formed of brilliant toner is formed by a specific fixing device, the brilliance may be reduced.

Therefore, in the unit according to the present exemplary embodiment, the fixing temperature of the specific fixing device is set to 130° C. or higher and 230° C. or lower (preferably 150° C. or higher and 210° C. or less). Accordingly, the toner image formed of the brilliant toner is sufficiently melted at the nip portion, and the brilliant pigment may be easily parallelized to the surface of the recording medium. As a result, a brilliant image with high brilliance formed of brilliant toner may be formed.

Here, the fixing temperature indicates the temperature of the nip portion.

In addition, in the unit according to the present exemplary embodiment, the fixing belt may be rotationally driven at a linear velocity of 180 mm/sec or more and 450 mm/sec or less (preferably 200 mm/sec or more and 430 mm/sec or less). By setting the fixing temperature to 130° C. or higher and 230° C. or lower and reducing the linear velocity of the fixing belt within the above range, sufficient heat is applied to the toner image formed of the brilliant toner. As a result, a brilliant image with high brilliance formed of brilliant toner may be formed.

In particular, when the nip portion of the specific fixing device is flat, it is difficult for the brilliant pigment to be parallel to the surface of the recording medium at the time of fixing, and the brilliance is likely to be reduced.

When the nip portion (that is, a contact surface between the fixing belt and the pressure roller) is curved along a shape of either one of the first roller and the pressure roller facing each other, a large shear force is applied to the brilliant toner at the nip portion (particularly, a nip portion outlet at which the curvature of the curved portion is large), and thus the brilliant pigment is easily parallelized to the surface of the recording medium at the time of fixing. On the other hand, when the nip portion is flat, a shear force is less likely to be applied to the brilliant toner. Therefore, the brilliance may be likely to be reduced when the nip portion is flat.

However, even in the specific fixing device in which the nip portion is flat, it may be possible to form a brilliant image with high brilliance formed of brilliant toner by setting the fixing temperature to 130° C. or higher and 230° C. or lower.

Here, the description "the nip portion is flat" means that the first roller and the pressure roller facing each other are arranged so as to be crushed from each other without biting into one roller, and the contact surface between the fixing belt and the pressure roller is not curved along the shape of either one of the first roller and the pressure roller before the arrangement.

[Image Forming Apparatus]

Hereinafter, an image forming apparatus including the unit according to the present exemplary embodiment will be described.

The image forming apparatus includes: a toner image forming device that includes an image carrier and a developing device configured to develop an electrostatic charge image that is formed on a surface of the image carrier, as a toner image with a developer including a brilliant toner containing a flat brilliant pigment, the developer being accommodated in the developing device; a transfer device configured to transfer the toner image formed on the surface of the image carrier to a surface of a recording medium; and a fixing device configured to fix the toner image onto the surface of the recording medium at a fixing temperature of 130° C. or higher and 230° C. or lower that includes a fixing belt, a first roller and a second roller that are disposed inside the fixing belt and support the fixing belt while applying tension to the fixing belt, and a pressure roller, the first roller and the pressure roller sandwiching the fixing belt to form a nip portion.

In other words, the image forming apparatus according to the present exemplary embodiment includes: a toner image forming device including an image carrier and a developing device of the unit according to the above present exemplary embodiment, configured to form a toner image on a surface of the image carrier; a transfer device configured to transfer the toner image formed on the surface of the image carrier onto a surface of a recording medium; and a fixing device of the unit according to the above present exemplary embodiment, configured to fix the toner image onto the surface of the recording medium.

Examples of the toner image forming device include a device including an image carrier, a charging device that charges a surface of the image carrier, an electrostatic charge image forming device that forms an electrostatic charge image on the charged surface of the image carrier, and a developing device that develops the electrostatic charge image formed on the surface of the image carrier with a developer containing brilliant toner to form a toner image.

As the image forming apparatus according to the present exemplary embodiment, known image forming apparatuses are applied. Examples thereof include: a direct transfer type apparatus that directly transfers the toner image formed on the surface of the image carrier onto the recording medium; an intermediate transfer type apparatus that primarily transfers the toner image formed on the surface of the image carrier onto a surface of an intermediate transfer body, and secondarily transfers the toner image transferred on the surface of the intermediate transfer body onto the surface of the recording medium, an apparatus including a cleaning device that cleans the surface of the image carrier after the transfer of the toner image and before charging; an apparatus including a discharging device that performs discharging by irradiating the surface of the image carrier with discharging light after the transfer of the toner image and before charging; and an apparatus including an image carrier heating member for increasing the temperature of the image carrier and lowering the relative temperature.

In the case of the intermediate transfer type apparatus, the transfer device includes, for example, an intermediate transfer body having a surface onto which a toner image is transferred, a primary transfer device that primarily transfers the toner image formed on a surface of an image carrier onto the surface of the intermediate transfer body, and a secondary transfer device that secondarily transfers the toner image transferred onto the surface of the intermediate transfer body onto a surface of a recording medium.

Hereinafter, an example of the image forming apparatus according to the present exemplary embodiment will be described, but the invention is not limited thereto. In the following description, the parts shown in the drawings will be described, and description of the other parts will be omitted.

In the following description, "silver toner" means the brilliant toner.

FIG. 1 is a schematic configuration diagram showing an example of an image forming apparatus of the present exemplary embodiment, and is a diagram showing an image forming apparatus of a five-tandem type and an intermediate transfer type.

The image forming apparatus shown in FIG. 1 includes first to fifth electrophotographic image forming units 150Y, 150M, 150C, 150K, and 150B (an example of a toner image forming device) that output images of respective colors of yellow (Y), magenta (M), cyan (C), black (K), and silver (B) based on image data subjected to color separation. The image forming units 150Y, 150M, 150C, 150K, and 150B are arranged side by side at predetermined intervals in the horizontal direction. The image forming units 150Y, 150M, 150C, 150K, and 150B may be process cartridges that are attached to and detached from the image forming apparatus.

In FIG. 1, reference numerals 111Y, 111M, 111C, 111K, and 111B denote photoreceptors, reference numerals 115Y, 115M, 115C, 115K, and 115B denote cleaning devices, reference numerals 118Y, 118M, 118C, 118K, and 118B denote charging rollers, and reference numerals 119Y, 119M, 119C, 119K, and 119B denote exposure devices.

An intermediate transfer belt 133 extends below the image forming units 150Y, 150M, 150C, 150K, and 150B through the image forming units 150Y, 150M, 150C, 150K, and 150B. The intermediate transfer belt 133 is wound around a drive roller 113, a support roller 112, and an opposing roller 114, which are in contact with an inner surface of the intermediate transfer belt 133, and runs in a direction from the first image forming unit 150Y toward the fifth image forming unit 150B (the direction of an arrow B in FIG. 1). An intermediate transfer belt cleaning device 116 is provided on an image carrying surface side of the intermediate transfer belt 133 in a manner of facing the drive roller 113. On an upstream side of the intermediate transfer belt cleaning device 116 in the rotation direction of the intermediate transfer belt 133, a voltage applying device 160 is provided to generate an electric field between the voltage applying device 160 and the intermediate transfer belt 133 by generating a potential difference between the voltage applying device 160 and the support roller 113.

Developing devices (examples of developing devices) 120Y, 120M, 120C, 120K, and 120B of the image forming units 150Y, 150M, 150C, 150K, and 150B are supplied with yellow, magenta, cyan, black, and silver toners stored in toner cartridges 140Y, 140M, 140C, 140K, and 140B, respectively.

Since the first to fifth image forming units 150Y, 150M, 150C, 150K, and 150B have the same configuration, operation, and function, here, the first image forming unit 150Y, which is arranged on the upstream side in the running direction of the intermediate transfer belt and forms a yellow image, will be described as a representative.

The first image forming unit 150Y includes a photoreceptor 111Y functioning as an image carrier. Around the photoreceptor 111Y, the following members are disposed in order: a charging roller (an example of a charging device) 118Y that charges a surface of the photoreceptor 111Y to a predetermined potential, an exposure device (an example of an electrostatic charge image forming device) 119Y that forms an electrostatic charge image by exposing the charged surface with a laser beam based on an image signal subjected to color separation, a developing device (an example of a developing device) 120Y that develops the electrostatic charge image by supplying a toner to the electrostatic charge image, a primary transfer roller (an example of a primary transfer device) 117Y that transfers the developed toner image onto the intermediate transfer belt 133, and a photoreceptor cleaning device (an example of a cleaning device) 115Y that removes the toner remaining on the surface of the photoreceptor 111Y after the primary transfer.

The primary transfer roller 117Y is disposed inside the intermediate transfer belt 133 and is provided at a position facing the photoreceptor 111Y. A bias power source (not shown) for applying a primary transfer bias is connected to each of the primary transfer rollers 117Y, 117M, 117C, 117K, and 117B of the respective image forming units. Each bias power source changes a value of the transfer bias applied to each primary transfer roller under the control of a controller (not shown).

Hereinafter, the operation of forming a yellow image in the first image forming unit 150Y will be described.

First, prior to the operation, the surface of the photoreceptor 111Y is charged to a potential of −600 V to −800 V by the charging roller 118Y.

The photoreceptor 111Y is formed by laminating a photoconductive layer on a conductive substrate (for example, having volume resistivity of $1\times10^{-6}$ Ωcm or less at 20° C.). The photoconductive layer usually has high resistance (corresponding to resistance of a general resin), but, when irradiated with a laser beam, the specific resistance of a portion irradiated with the laser beam changes. Therefore, the charged surface of the photoreceptor 111Y is irradiated with a laser beam from the exposure device 119Y in accordance with yellow image data sent from the controller (not shown). As a result, an electrostatic charge image having a yellow image pattern is formed on the surface of the photoreceptor 111Y.

The electrostatic charge image is an image formed on the surface of the photoreceptor 111Y by charging, and is a so-called negative latent image formed by lowering the specific resistance of the portion of the photoconductive layer irradiated with the laser beam from the exposure device 119Y to flow a charge charged on the surface of the photoreceptor 111Y and by, on the other hand, leaving a charge of a portion not irradiated with the laser beam.

The electrostatic charge image formed on the photoreceptor 111Y rotates to a predetermined developing position as the photoreceptor 111Y runs. Then, at this developing position, the electrostatic charge image on the photoreceptor 111Y is developed and visualized as a toner image by the developing device 120Y.

In the developing device 120Y, for example, a developer containing at least a yellow toner and a carrier is accommodated. The yellow toner is triboelectrically charged by being stirred inside the developing device 120Y, and has a charge of the same polarity (specifically, negative polarity) as the charge charged on the photoreceptor 111Y and is carried on a developer roller (an example of a developer carrier). Then, when the surface of the photoreceptor 111Y passes through the developing device 120Y, the yellow toner electrostatically adheres to a discharged latent image portion on the surface of the photoreceptor 111Y, and the latent image is developed by the yellow toner. The photoreceptor 111Y on which the yellow toner image is formed continuously runs at a predetermined speed, and the toner image developed on the photoreceptor 111Y is conveyed to a predetermined primary transfer position.

When the yellow toner image on the photoreceptor 111Y is conveyed to the primary transfer position, a primary transfer bias is applied to the primary transfer roller 117Y, an electrostatic force from the photoreceptor 111Y to the primary transfer roller 117Y acts on the toner image, and the toner image on the photoreceptor 111Y is transferred onto the intermediate transfer belt 133. The transfer bias applied at this time has a polarity (+) opposite to the polarity (−) of the toner, and is controlled to, for example, +10 μA by the controller (not shown) in the first image forming unit 150Y.

On the other hand, the toner remaining on the photoreceptor 111Y is removed and collected by the photoreceptor cleaning device 115Y.

The primary transfer biases applied to the primary transfer rollers 117M, 117C, 117K, and 117B of the second image forming unit 150M and the subsequent units are also controlled in the same manner as in the first image forming unit 150Y.

In this way, the intermediate transfer belt 133 onto which the yellow toner image is transferred by the first image forming unit 150Y is sequentially conveyed through the second to fifth image forming units 150M, 150C, 150K, and 150B, and the toner images of the respective colors are superimposed and transferred in a multiple manner.

The intermediate transfer belt 133 onto which the toner images of five colors are transferred in a multiple manner through the first to fifth image forming units arrives at a secondary transfer unit including the intermediate transfer belt 133, the opposing roller 114 in contact with an inner surface of the intermediate transfer belt, and a secondary transfer roller (an example of a secondary transfer device) 134 disposed on the image carrying surface side of the intermediate transfer belt 133. On the other hand, a recording sheet (an example of a recording medium) P is fed through a supply mechanism into a gap where the secondary transfer roller 134 and the intermediate transfer belt 133 are in contact with each other at a predetermined timing, and a secondary transfer bias is applied to the opposing roller 114. The transfer bias applied at this time has the same polarity (−) as the polarity (−) of the toner. The electrostatic force from the intermediate transfer belt 133 to the recording paper P acts on the toner image, and the toner image on the intermediate transfer belt 133 is transferred onto the recording sheet P. The secondary transfer bias at this time is determined according to a resistance detected by a resistance detecting device (not shown) that detects the resistance of the secondary transfer unit, and is subjected to voltage control.

Thereafter, the recording sheet P is sent to a pressure contact portion (so-called nip portion) of a pair of fixing rollers in a fixing device (an example of a fixing device) 135, and the toner image is fixed onto the recording sheet P, thereby forming a fixed image.

Examples of the recording sheet P onto which the toner image is transferred include plain paper used in electrophotographic copiers and printers. As the recording medium, in addition to the recording sheet P, an OHP sheet or the like may be used.

In order to further improve the smoothness of the image surface after fixing, the surface of the recording sheet P is also preferably smooth. For example, coated paper obtained by coating the surface of plain paper with a resin or the like, art paper for printing, or the like is preferably used.

The recording sheet P on which the fixing of the color image is completed is conveyed out toward a discharge unit, and a series of color image forming operations is completed.

Here, the developing device 120B of the image forming unit 150B corresponds to an example of the developing device in the unit according to the above present exemplary embodiment.

The fixing device 135 corresponds to an example of the transfer device in the unit according to the above present exemplary embodiment.

A device including the developing device 120B and the fixing device 135 corresponds to an example of the unit according to the above present exemplary embodiment.

The image forming apparatus shown in FIG. 1 is an image forming apparatus having a configuration in which the toner cartridges 140Y, 140M, 140C, 140K, and 140B are attached and detached, and the developing devices 120Y, 120M, 120C, 120K, and 120B are connected to toner cartridges corresponding to the respective developing devices (colors) by toner supply pipes (not shown). When the amount of the toner accommodated in the toner cartridge decreases, the toner cartridge is replaced.

[Developing Device]

Hereinafter, the developing device of the unit and the image forming apparatus according to the present exemplary embodiment will be described in more detail. In the following description, reference numerals will be omitted.

The developing device is provided, for example, on the downstream side in the rotation direction of the image carrier from the light irradiation position of the electrostatic charge image forming device. In the developing device, an accommodating unit for accommodating the developer is provided. The developer including the brilliant toner containing the brilliant pigment is accommodated in the accommodating unit. The brilliant toner is accommodated, for example, in a charged state in the developing device. Details of the brilliant toner will be described later.

The developing device includes, for example, a developing member that develops an electrostatic charge image formed on a surface of the image carrier with a developer containing brilliant toner, and a power source that applies a developing voltage to the developing member. The developing member is electrically connected to, for example, a power source.

The developing member of the developing device is selected according to the type of the developer, and examples of the developing member include a developing roller including a developing sleeve with a built-in magnet.

In the developing device (including a power source), for example, a developing voltage is applied to the developing member. The developing member to which the developing voltage is applied is charged to a developing potential corresponding to the developing voltage. The developing member charged to the developing potential holds, for example, the developer accommodated in the developing device on the surface thereof, and supplies the brilliant toner contained in the developer from the developing device to the surface of the image carrier.

The toner supplied onto the image carrier adheres to, for example, an electrostatic charge image on the image carrier by the electrostatic force. Specifically, for example, by the potential difference in a region where the image carrier and the developing member face each other, that is, the potential difference between the potential of the surface of the image carrier in the region and the developing potential of the developing member, the brilliant toner contained in the developer is supplied to a region of the image carrier where the electrostatic charge image is formed. When the developer contains a carrier, the carrier returns to the developing device while being held by the developing member.

For example, the electrostatic charge image on the image carrier is developed by the brilliant toner supplied from the developing member, and a toner image corresponding to the electrostatic charge image is formed on the image carrier.

[Brilliant Toner]

Hereinafter, the brilliant toner will be described.

The brilliant toner contains a flat brilliant pigment.

Specifically, the brilliant toner includes brilliant toner particles containing the brilliant pigment. The brilliant toner may contain an external additive.

[Brilliant Toner Particles]

The brilliant toner particles include, for example, a binder resin and a brilliant pigment. The brilliant toner particles may contain a colorant other than the brilliant pigment, a release agent, and other components.

—Binder Resin—

Examples of the binder resin include vinyl resins composed of homopolymers of monomers such as styrenes (such as styrene, parachlorostyrene, and α-methylstyrene), (meth) acrylates (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene), or copolymers obtained by combining two or more of these monomers.

Examples of the binder resin include a non-vinyl resin such as an epoxy resin, a polyester resin, a polyurethane resin, a polyamide resin, a cellulose resin, a polyether resin, and a modified resin, a mixture of the non-vinyl resin and the vinyl resin, and a graft polymer obtained by polymerizing a vinyl monomer in the presence of the non-vinyl resin and the vinyl resin.

These binder resins may be used alone or in combination of two or more thereof.

In particular, it is preferable to use an amorphous resin and a crystalline resin as the binder resin.

In this case, the mass ratio (crystalline resin/amorphous resin) of the crystalline resin to the amorphous resin is preferably 3/97 or more and 50/50 or less, and more preferably 7/93 or more and 30/70 or less.

Here, the amorphous resin refers to a resin that has only a stepwise endothermic change instead of a clear endothermic peak in thermal analysis measurement using differential scanning calorimetry (DSC), and refers to a resin that is solid at normal temperature and is thermoplasticized at a temperature equal to or higher than the glass transition temperature.

On the other hand, the crystalline resin refers to a resin that has a clear endothermic peak instead of a stepwise endothermic change in differential scanning calorimetry (DSC).

Specifically, for example, the crystalline resin means that the half-value width of the endothermic peak measured at a temperature rising rate of 10° C./min is within 10° C., and the amorphous resin means a resin having a half-value width exceeding 10° C. or a resin for which a clear endothermic peak is not recognized.

The amorphous resin will be described.

Examples of the amorphous resin include known amorphous resins such as an amorphous polyester resin, an amorphous vinyl resin (such as a styrene acrylic resin), an epoxy resin, a polycarbonate resin, and a polyurethane resin. Among these, the amorphous polyester resin and the amorphous vinyl resin (particularly, a styrene acrylic resin) are preferred, and the amorphous polyester resin is more preferred.

It is also preferable to use an amorphous polyester resin and a styrene acrylic resin in combination as the amorphous resin. It is also preferable to use an amorphous resin having an amorphous polyester resin segment and a styrene acrylic resin segment as the amorphous resin.

Examples of the crystalline resin include known crystalline resins such as crystalline polyester resins and crystalline vinyl resins (such as polyalkylene resins and long-chain alkyl (meth)acrylate resins). Among these, the crystalline polyester resin is preferred from the viewpoint of mechanical strength and low-temperature fixability of the brilliant toner.

A content of the binder resin is preferably 40 mass % or more and 95 mass % or less, more preferably 50 mass % or more and 90 mass % or less, and still more preferably 60 mass % or more and 85 mass % or less with respect to a total amount of the brilliant toner particles.

—Brilliant Pigment—

Examples of the brilliant pigment include a pigment capable of providing a brilliance such as metallic luster. Specific examples of the brilliant pigment include: metal powders such as aluminum (metal of Al alone), brass, bronze, nickel, stainless steel, and zinc; mica coated with titanium oxide, yellow iron oxide, or the like; coated flaky inorganic crystal substrates such as barium sulfate, layered silicate, and layered aluminum silicate; single crystal plate-shaped titanium oxide; basic carbonate; bismuth oxychloride; natural guanine; flaky glass powder; and metal-deposited flaky glass powder, and the brilliant pigment is not particularly limited as long as it has brilliance.

Among these, as the brilliant pigment, metal powder is particularly preferred from the viewpoint of specular reflection intensity, and among these, aluminum is most preferred.

The average length in the long axis direction of the brilliant pigment is preferably 1 μm or more and 30 μm or less, more preferably 3 μm or more and 20 μm or less, and still more preferably 5 μm or more and 15 μm or less.

When the average length in the thickness direction of the brilliant pigment is set as 1, the ratio (aspect ratio) of the average length in the long axis direction to the average length in the thickness direction is preferably 5 or more and 200 or less, more preferably 10 or more and 100 or less, and still more preferably 30 or more and 70 or less.

The respective average length and the aspect ratio of the brilliant pigment are measured by the following method.

Using a scanning electron microscope (S-4800, manufactured by Hitachi High-Tech Corporation), a photograph of the brilliant pigment is taken at a measurable magnification (300 to 100,000 times), the length in the long axis direction and the length in the thickness direction of each particle are measured in a state where the obtained image of the brilliant pigment is converted into a two-dimensional image, and the average length in the long axis direction of the brilliant pigment and the aspect ratio of the brilliant pigment are calculated.

Here, the length in the long axis direction of the brilliant pigment refers to the longest portion when the brilliant pigment is observed in the thickness direction of the brilliant pigment. The length in the thickness direction of the brilliant pigment refers to the longest portion when the brilliant pigment is observed from a direction orthogonal to the thickness direction of the brilliant pigment.

The volume average particle diameter of the brilliant pigment is preferably 1.0 μm or more and 20.0 μm or less, and more preferably 2.0 μm or more and 15.0 μm or less.

The volume average particle diameter of the brilliant pigment is measured as follows.

A cumulative distribution is drawn from a small particle diameter side with respect to the divided particle size range (so-called channels) based on the volume-based particle diameter distribution measured by a measuring instrument such as Multisizer II (manufactured by Beckman Coulter, Inc.), and the particle diameter corresponding to the cumulative percentage of 50% is defined as the volume average particle diameter.

As a method of measuring the volume average particle diameter of the brilliant pigment in the brilliant toner particles after the production, a solvent capable of dissolving only the resin without dissolving the brilliant pigment and the brilliant toner are mixed and stirred, and after the resin is sufficiently dissolved in the solvent, the brilliant pigment is subjected to solid-liquid separation, and the volume average particle diameter is measured by the same particle size distribution measuring device as described above.

The content of the brilliant pigment with respect to the total mass of the brilliant toner particles is preferably 1 mass % or more and 70 mass % or less, more preferably 5 mass % or more and 50 mass % or less, and still more preferably 5 mass % or more and 40 mass % or less.

—Colorant Other than Brilliant Pigment—

Examples of the colorant other than the brilliant pigment include: pigments such as Carbon Black, Chrome Yellow, Hansa Yellow, Benzidine Yellow, Threne Yellow, Quinoline Yellow, Pigment Yellow, Permanent Orange GTR, Pyrazolone Orange, Vulcan Orange, Watchung Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco oil Blue, Methylene Blue Chloride, Phthalocyanine Blue, Pigment Blue, Phthalocyanine Green, and Malachite Green Oxalate; and dyes such as acridine dyes, xanthene dyes, azo dyes, benzoquinone dyes, azine dyes, anthraquinone dyes, thioindico dyes, dioxazine dyes, thiazine dyes, azomethine dyes, indico dyes, phthalocyanine dyes, aniline black dyes, polymethine dyes, triphenylmethane dyes, diphenylmethane dyes, and thiazole dyes.

The colorant other than the brilliant pigment may be used alone or in combination of two or more kinds thereof.

As the colorant other than the brilliant pigment, a surface-treated colorant may be used as necessary, or the colorant may be used in combination with a dispersant. Plural kinds of colorants may be used in combination.

The content of the colorant other than the brilliant pigment is adjusted according to the color tone of the brilliant toner.

—Release Agent—

Examples of the release agent include: hydrocarbon wax; natural wax such as carnauba wax, rice wax, and candelilla wax; synthetic wax or mineral or petroleum wax such as montan wax; and ester wax such as fatty acid ester and montanic acid ester. The release agent is not particularly limited thereto.

The melting temperature of the release agent is preferably 50° C. or higher and 110° C. or lower, and more preferably 60° C. or higher and 100° C. or lower.

The melting temperature of the release agent is determined based on a DSC curve obtained by differential scanning calorimetry (DSC) according to "melting peak temperature" described in the method of determining the melting temperature in JIS K7121: 1987 "Testing Methods for Transition Temperatures of Plastics".

A content of the release agent is preferably 1 mass % or more and 20 mass % or less, and more preferably 5 mass % or more and 15 mass % or less, with respect to the total amount of the brilliant toner particles.

—Other Additives—

Examples of the other additives include known additives such as a magnetic body, an electrostatic charge control agent, and an inorganic powder. These additives are contained in the brilliant toner particles as internal additives.

—Properties of Brilliant Toner Particles—

The brilliant toner particles have a flake shape, and the average circle-equivalent diameter D of the brilliant toner particles is larger than the average maximum thickness C thereof.

Figure 2:
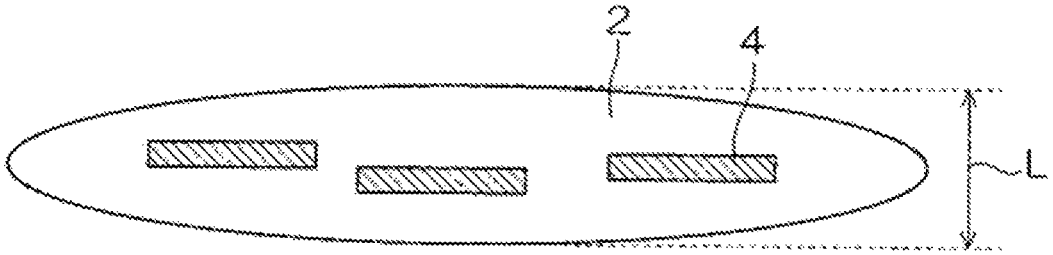
FIG. 2 is cross-sectional view schematically showing an example of brilliant toner.

When the brilliant toner particles have a flake shape in which the circle-equivalent diameter is larger than the thickness (see FIG. 2), it is considered that the brilliant toner particles are arranged such that the flat surface sides of the brilliant toner particles face the surface of the recording medium due to the pressure at the time of fixing in the fixing step of image formation. In FIG. 2, reference numeral 2 denotes a brilliant toner particle, reference numeral 4 denotes a brilliant pigment, and reference numeral L denotes a thickness of the brilliant toner particle.

The ratio C/D of the average maximum thickness C to the average circle-equivalent diameter D is preferably within the range of 0.001 or more and 0.700 or less, more preferably within the range of 0.001 or more and 0.500 or less, still more preferably within the range of 0.100 or more and 0.600 or less, and particularly preferably within the range of 0.300 or more and 0.450 or less.

When the ratio C/D is 0.001 or more, the strength of the toner particles is ensured, breakage due to stress at the time of image formation is prevented, and a decrease in charging due to exposure of the brilliant pigment and fogging caused as a result are prevented. On the other hand, excellent brilliance may be obtained when the ratio C/D is 0.700 or less.

The average maximum thickness C and the average circle-equivalent diameter D described above are measured by the following method.

The brilliant toner particles are placed on a smooth surface, and are subjected to vibration to be dispersed without unevenness. 1,000 toner particles are enlarged by 1,000 times using a color laser microscope "VK-9700" (manufactured by Keyence Corporation), the maximum thickness C of the toner particles and the circle-equivalent diameter D of the surface seen from above are measured, and the arithmetic mean values of the maximum thickness C and the circle-equivalent diameter D are determined, thereby calculating the average maximum thickness C and the average circle-equivalent diameter D.

In a case where the cross-sections of the brilliant toner particles in the thickness direction are observed, the proportion (number basis) of the brilliant pigments in which the angle between the long axis direction of the toner particle in the cross-section and the long axis direction of the brilliant pigment is within the range of −30° to +30° is preferably 60% or more in all the brilliant pigments to be observed. Further, the above proportion is more preferably 70% or more and 95% or less, and particularly preferably 80% or more and 90% or less.

Excellent brilliance may be obtained when the above proportion is 60% or more.

Here, a method of observing the cross sections of the brilliant toner particles will be described.

The toner particles are embedded using a bisphenol A type liquid epoxy resin and a curing agent, and then a sample for cutting is prepared. Next, the sample for cutting is cut at −100° C. using a cutting machine that uses a diamond knife, for example, an Ultramicrotome device (Ultracut UCT, manufactured by Leica) to prepare a sample for observation. The sample for observation is observed with, for example, an ultrahigh resolution field emission scanning electron microscope (S-4800, manufactured by Hitachi High-Tech Corporation) at a magnification at which approximately one to ten brilliant pigment toner particles can be seen in one field of view.

Specifically, the cross sections of the brilliant toner particles (more specifically, the cross sections along the thickness direction of the brilliant toner particles) are observed, and regarding the observed 100 brilliant toner particles, the number of brilliant pigments in which the angle between the long axis direction of the cross section of the brilliant toner particles and the long axis direction of the brilliant pigment is within the range of −30° to +30° is counted using, for example, image analysis software such as image analysis software (Win ROOF) manufactured by Mitani Corporation, or an output sample of the observed image and a protractor, and the ratio thereof is calculated.

The volume average particle diameter of the brilliant toner particles is preferably 3 μm or more and 30 μm or less, and more preferably 5 μm or more and 20 μm or less.

Various average particle diameters and various particle size distribution indices of the brilliant toner particles are measured by using a Coulter Multisizer II (manufactured by Beckman Coulter, Inc.) and ISOTON-II (manufactured by Beckman Coulter, Inc.) as an electrolytic solution.

In the measurement, 0.5 mg or more and 50 mg or less of a measurement sample is added to 2 ml of a 5 mass % aqueous solution of a surfactant (preferably sodium alkylbenzenesulfonate) as a dispersant. The obtained mixture is added to 100 ml or more and 150 ml or less of the electrolytic solution.

The electrolytic solution in which the sample is suspended is subjected to a dispersion treatment for 1 minute with an ultrasonic disperser, and the Coulter Multisizer II is used to measure the particle size distribution of particles having a particle diameter within the range of 2 μm or more and 60 μm or less using an aperture having an aperture diameter of 100 μm. The number of particles to be sampled is 50,000.

A cumulative distribution is drawn from the small particle diameter side with respect to the divided particle diameter range (so-called channel) based on the measured volume-based particle diameter distribution, and a particle diameter corresponding to the cumulative percentage of 16% is defined as a volume particle diameter D16v, a particle diameter corresponding to the cumulative percentage of 50% is defined as a volume average particle diameter D50v, and a particle diameter corresponding to the cumulative percentage of 84% is defined as a volume particle diameter D84v.

A cumulative distribution is drawn from the small particle diameter side with respect to the divided particle diameter range (so-called channel) based on the measured number-based particle diameter distribution, and a particle diameter corresponding to the cumulative percentage of 16% is defined as a number particle diameter D16p, a particle diameter corresponding to the cumulative percentage of 50% is defined as a number average particle diameter D50p, and a particle diameter corresponding to the cumulative percentage of 84% is defined as a number particle diameter D84p.

Using these, the volume particle size distribution index (GSDv) is calculated as $(D84v/D16v)^{1/2}$, and the number particle size distribution index (GSDp) is calculated as $(D84p/D16p)^{1/2}$.

When the average length in the thickness direction of the brilliant toner particles is set as 1, the ratio (aspect ratio) of the average length in the long axis direction to the average length in the thickness direction is preferably 1.5 or more and 15 or less, more preferably 2 or more and 10 or less, and still more preferably 3 or more and 8 or less.

The average length in the thickness direction of the brilliant toner particles and the average length in the long axis direction are calculated as follows: the brilliant toner particles are placed on a smooth surface and are subjected to vibration to be dispersed without unevenness. 1,000 brilliant toner particles are enlarged by 1,000 times using a color laser microscope "VK-9700" (manufactured by Keyence Corporation), the maximum thickness of the brilliant toner particles and the length of the surface seen from above in the long axis direction are measured, and the arithmetic mean values of the maximum thickness and the length are determined, thereby calculating the average length in the thickness direction of the brilliant toner particles and the average length in the long axis direction.

(External Additive)

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, CaO $SiO_2$, $K_2O$ $(TiO_2)_n$, $Al_2O_32SiO_2$, $CaCO_3$, $MgCO_3$, $BaSO_4$, and $MgSO_4$.

The surfaces of the inorganic particles as the external additive are preferably subjected to a hydrophobic treatment. The hydrophobic treatment is performed by, for example, immersing the inorganic particles in a hydrophobic treatment agent. The hydrophobic treatment agent is not particularly limited. Examples thereof include a silane coupling agent, a silicone oil, a titanate coupling agent, and an aluminum coupling agent. The hydrophobic treatment agent may be used alone or in combination of two or more thereof.

An amount of the hydrophobic treatment agent is generally, for example, 1 part by mass or more and 10 parts by mass or less based on 100 parts by mass of the inorganic particles.

Examples of the external additive also include resin particles (resin particles such as polystyrene, polymethylmethacrylate (PMMA), and melamine resin), and cleaning activators (for example, metal salts of higher fatty acids represented by zinc stearate, and particles of a fluoropolymer).

The amount of the external additive externally added is, for example, preferably 0.01 mass % or more and 5 mass % or less, and more preferably 0.01 mass % or more and 2.0 mass % or less, based on the toner particles.

(Properties of Brilliant Toner)

The brilliant toner is sufficiently melted in the nip portion of the fixing device, and thus a brilliant image with high brilliance formed of the brilliant toner may be formed.

Therefore, the viscosity of the brilliant toner at 130° C. is preferably 100 Pa·s or more and 1,000 Pa·s or less, and more preferably 150 Pa·s or more and 800 Pa·s or less.

The viscosity of the brilliant toner may be adjusted by the type, the molecular weight, and the like of the binder resin.

Here, the viscosity of the brilliant toner is measured at 130° C. using "ARES (device name)" (manufactured by Rheometrics Co., Ltd.).

The "brilliance" of a brilliant image formed of the brilliant toner means that the image has brilliance such as metallic luster when viewed.

Specifically, when the brilliant toner forms a solid image (for example, an image in which the loading amount of brilliant toner is 3.5 g/m$^2$ or more), it is preferable that a ratio (X/Y) of a reflectance X at a light receiving angle of +30° to a reflectance Y at a light receiving angle of −30°, which are measured when the image is irradiated with incident light at an incident angle of −45° by a goniophotometer, is 2 or more and 100 or less.

The ratio (X/Y) of 2 or more indicates that there is more reflection to the side (angle + side) opposite to the incident side than reflection to the side where the incident light is incident (angle − side), that is, irregular reflection of the incident light is prevented. In a case where irregular reflection occurs in which incident light is reflected in various directions, the color appears dull when the reflected light is visually confirmed. Therefore, in a case where the ratio (X/Y) is less than 2, luster may not be confirmed even when the reflected light is visually recognized, and the brilliance may be poor.

On the other hand, when the ratio (X/Y) is more than 100, the viewing angle at which the reflected light can be visually recognized becomes too narrow, and the specular reflection light component is large. Thus, the reflected light may appear blackish depending on the viewing angle. In addition, it is difficult to manufacture a toner having a ratio (X/Y) of more than 100.

The ratio (X/Y) is more preferably 4 or more and 50 or less, still more preferably 6 or more and 20 or less, and particularly preferably 8 or more and 15 or less.

—Measurement of Ratio (X/Y) Using Goniophotometer—

First, the incident angle and the light receiving angle will be described here. In the present exemplary embodiment, the incident angle is set to −45° during the measurement depending on the goniophotometer, and this is because the measurement sensitivity is high for an image in a wide range of luster.

In addition, the reason for setting the light receiving angle to −30° and +30° lies in highest measurement sensitivity for evaluating brilliant and non-brilliant images.

Next, a method of measuring the ratio (X/Y) will be described.

For an image (brilliant image) to be measured, a spectral variable angle color difference meter GC5000L manufactured by Nippon Denshoku Industries Co., Ltd. is used as a goniophotometer to measure a reflectance X at a light receiving angle of +30° and a reflectance Y at a light receiving angle of −30° after incident light with an incident angle of −45° is incident onto the image. In addition, the reflectance X and the reflectance Y are measured with the light, which has a wavelength within a range from 400 nm to 700 nm, at intervals of 20 nm, and are average values of the reflectance at respective wavelengths. The ratio (X/Y) is calculated based on these measurement results.

From the viewpoint of satisfying the ratio (X/Y), the brilliant toner preferably satisfies the following requirements (1) and (2). (1) The average circle-equivalent diameter D is larger than the average maximum thickness C of the brilliant toner particles. (2) In a case where the cross-sections of the brilliant toner particles in the thickness direction are observed, the proportion of the brilliant pigments in which the angle between the long axis direction of the toner particle in the cross-section and the long axis direction of the brilliant pigment is within the range of −30° to +30° is 60% or more in all the brilliant pigments to be observed.

[Method for Producing Brilliant Toner]

The brilliant toner is obtained, for example, by preparing brilliant toner particles and then externally adding an external additive to the brilliant toner particles.

The brilliant toner particles may be produced by either a dry production method (e.g., a kneading pulverization method) or a wet production method (e.g., an aggregation and coalescence method, a suspension polymerization method, and a dissolution suspension method). These production methods are not particularly limited and known production methods are adopted. Among these, the brilliant toner particles are preferably obtained by the aggregation and coalescence method.

[Developer]

The developer may be a one-component developer containing only the brilliant toner, or may be a two-component developer obtained by mixing the brilliant toner with a carrier.

The carrier is not particularly limited, and examples thereof include known carriers. Examples of the carrier include a coated carrier in which a surface of a core made of a magnetic powder is coated with a coating resin; a magnetic powder dispersion-type carrier in which a magnetic powder is dispersed and blended in a matrix resin; and a resin impregnation-type carrier in which a porous magnetic powder is impregnated with a resin.

The magnetic powder dispersion-type carrier and the resin impregnation-type carrier may be carriers in which constituent particles of the carrier are core materials, and the core material is coated with a coating resin.

A mixing ratio (mass ratio) of the toner to the carrier in the two-component developer is preferably toner:carrier=1:100 to 30:100, and more preferably 3:100 to 20:100.

[Fixing Device]

Hereinafter, the fixing device of the unit and the image forming apparatus according to the present exemplary embodiment will be described in more detail.

Figure 3:
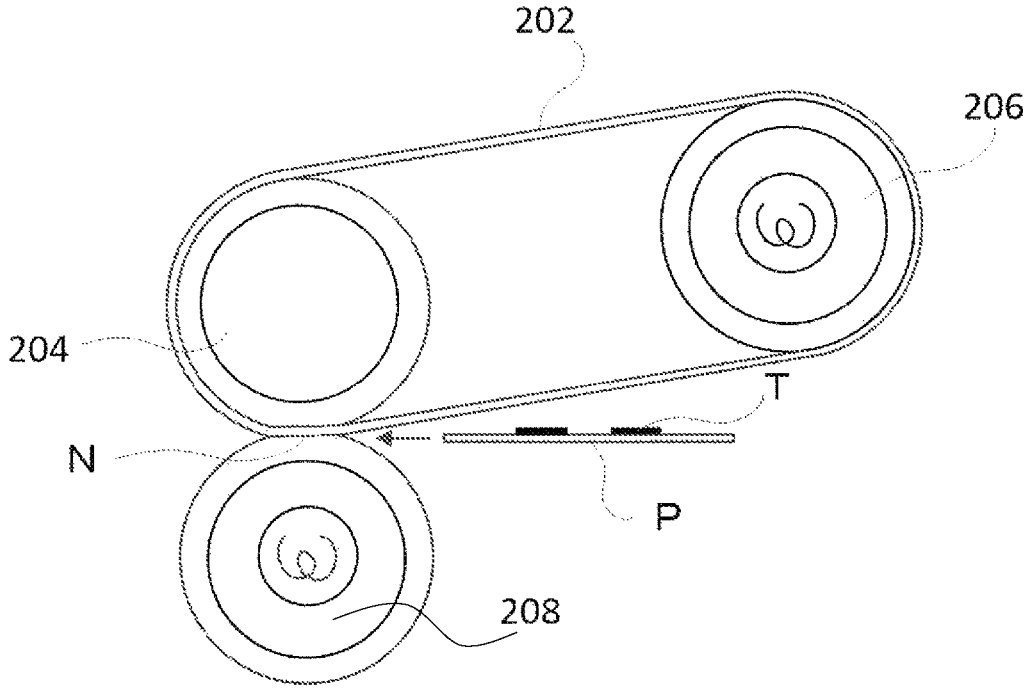
FIG. 3 is a schematic configuration diagram showing an example of a fixing device of a unit and an image forming apparatus according to the present exemplary embodiment.

FIG. 3 is a schematic configuration diagram showing an example of a fixing device (that is, a specific fixing device) of the unit and the image forming apparatus according to the present exemplary embodiment. FIG. 3 only shows the parts of the fixing device.

The fixing device shown in FIG. 3 includes, for example, a fixing belt 202, a fixing roller 204 (an example of a first roller) and a heating roller 206 (an example of a second roller) disposed inside the fixing belt 202, and a pressure roller 208 facing the fixing roller 204 with the fixing belt 202 interposed therebetween.

The fixing roller 204 and the pressure roller 208 apply tension to the fixing belt 202 and support the fixing belt 202.

The pressure roller 208 and the fixing roller 204 form a nip portion (that is, a contact portion) N with the fixing belt 202 interposed therebetween.

The fixing belt 202 is, for example, an endless belt in which a base material layer, an elastic layer, and a release layer are laminated in this order.

The base material layer is, for example, a layer of a heat-resistant resin such as a polyimide resin, an aromatic polyamide resin, a polyester resin, a polyethylene terephthalate resin, a polyether sulfone resin, a polyether ketone resin, a polysulfone resin, and a polyimide amide resin.

The elastic layer is, for example, a layer of heat-resistant elastic material such as silicone rubber and fluororubber.

The release layer is, for example, a layer of a heat-resistant release agent such as fluorine rubber, a fluorine resin, a silicone resin, and a polyimide resin.

The base material layer, the elastic layer, and the release layer may contain known additives such as a conductive agent and a filler.

The fixing roller 204 is, for example, a roller including a metal roller and an elastic layer provided on an outer circumferential surface of the metal roller.

The heating roller 206 is, for example, a roller including a metal roller with a built-in heating source (such as a halogen lamp) and an elastic layer provided on an outer circumferential surface of the metal roller.

The pressure roller 208 includes, for example, a metal roller with a built-in heat source (such as a halogen lamp) and an elastic layer provided on an outer circumferential surface of the metal roller.

The metal roller is, for example, a hollow roller made of copper, aluminum, stainless steel (SUS), sulfur composite steel (SUM), various alloys, or the like.

The elastic layer is, for example, a layer of heat-resistant elastic material such as silicone rubber and fluororubber. The elastic layer may contain known additives such as a conductive agent and a filler.

In the fixing device shown in FIG. 3, the fixing roller 204 and the pressure roller 208 are pressed against each other with the fixing belt 202 interposed therebetween in a state where elastic layers of the fixing roller 204 and the pressure roller 208 are crushed. Thus, a flat nip portion N is formed.

In order to flatten the nip portion N, for example, the fixing roller 204 (an example of the first roller) and the pressure roller 208 may adopt the following aspects.

1) The difference (absolute value) between a surface hardness of the fixing roller 204 and a surface hardness of the pressure roller 208 is within 15°.

2) The surface hardness of the fixing roller 204 is 35° or more and 45° or less.

3) The surface hardness of the pressure roller 208 is 40° or more and 50° or less.

4) A load is applied to the fixing roller 204 and the pressure roller 208 such that the pressure on the nip portion N is 2.0 kgf/cm$^2$ or more and 7.0 kgf/cm$^2$ or less (preferably 4.0 kgf/cm$^2$ or more and 7.0 kgf/cm$^2$ or less).

5) The outer diameter ratio (fixing roller 204/pressure roller 208) of the fixing roller 204 to the pressure roller 208 is 0.9 or more and 1.3 or less.

When the fixing roller 204 (an example of the first roller) and the pressure roller 208 adopt the aspects 1) to 5), the nip portion N is flat.

Here, the surface hardness of the roller is an Asker C hardness, and is a hardness measured by an Asker C hardness meter.

In the fixing device shown in FIG. 3, in a state where the fixing belt 202, the fixing roller 204, the heating roller 206, and the pressure roller 208 are rotated, the fixing belt 202 is heated from an inner circumferential surface by the heating source of the heating roller 206, and the nip portion N is directly heated by the heating source of the pressure roller 208. The linear velocity of the fixing belt 202 at this time is, for example, 180 mm/sec or more and 450 mm/sec or less.

Then, in a state where the fixing temperature (that is, the temperature of the nip portion) is set to 130° C. or higher and 230° C. or lower, the recording medium P to which the toner image T is transferred is passed through the nip portion. As a result, the toner image T is fixed to the recording medium P, and an image is formed.

Here, when the fixing temperature (that is, the temperature of the nip portion) is set to 130° C. or higher and 230° C. or lower, the toner image formed of the brilliant toner is sufficiently melted in the nip portion N, and the brilliant pigment is easily parallelized to the surface of the recording medium even in the fixing device (that is, the specific fixing device) shown in FIG. 3. As a result, a brilliant image with high brilliance formed of brilliant toner may be formed.

In addition, when the fixing belt is rotationally driven at a linear velocity of 180 mm/sec or more and 450 mm/sec or less, sufficient heat is applied to the toner image formed of the brilliant toner at the nip portion N, the toner image is further melted, and the brilliant pigment is easily parallelized to the surface of the recording medium even in the fixing device (that is, the specific fixing device) shown in FIG. 3. As a result, a brilliant image with high brilliance formed of brilliant toner may be formed.

The fixing device shown in FIG. 3 is not limited to the above-described configuration as long as the fixing device corresponds to a specific fixing device.

The fixing device shown in FIG. 3 may include a metal roller instead of the heating roller 206, which supports the fixing belt 202 and heats the fixing belt 202 by electromagnetic induction, and an electromagnetic induction unit that faces the metal roller with the fixing belt 202 interposed therebetween and includes an electromagnetic induction coil.

Here, although not shown, the image forming apparatus according to the present exemplary embodiment including the fixing device may include, for example, a central processing unit (CPU), a read only memory (ROM), a random access memory (RAM), a storage, a communication interface, an input unit, and a display unit. The respective components are connected to each other via a bus 28 so as to be able to communicate with each other.

The CPU is a central arithmetic processing unit, and executes various programs and controls each unit. That is, the CPU reads the program from the ROM or the storage, and executes the program using the RAM as a work area. The CPU controls the above-described components and performs various types of arithmetic processing in accordance with a program recorded in the ROM or the storage.

The ROM stores various programs and various data.

The RAM temporarily stores programs or data as a work area.

The storage is configured with a storage device such as a hard disk drive (HDD), a solid state drive (SSD), or a flash memory, and stores various programs including an operating system and various data.

The communication interface is an interface for communicating with other devices. For example, a wired communication standard such as Ethernet (registered trademark) or FDDI, or a wireless communication standard such as 4G, 5G, or Wi-Fi (registered trademark) is used for the communication.

The input unit includes a pointing device such as a mouse and a keyboard, and is used to perform various inputs.

The display unit is, for example, a liquid crystal display, and displays various information. The display unit may function as the input unit by employing a touch panel method.

For example, the ROM or the storage stores a program for controlling the fixing temperature of the fixing device, a program for controlling the rotation speed of the fixing belt (for example, a program for controlling a motor for rotationally driving the fixing roll) of the fixing device, and the like. The CPU reads and executes a program stored in the ROM or the storage, thereby controlling the fixing device.

In each of the above exemplary embodiments, the processing executed by reading the software (program) by means of the CPU may be executed by various processors other than the CPU. Examples of the processor in this case include a programmable logic device (PLD) whose circuit configuration can be changed after manufacture of a field-programmable gate array (FPGA) or the like, a dedicated electric circuit being a processor having a circuit configuration designed exclusively to execute specific processing such as an application specific integrated circuit (ASIC), and the like. The processing may be executed by one of these various processors, or may be executed by a combination of two or more processors of the same type or different types (for example, a combination of plural FPGAs and a combination of a CPU and an FPGA). More specifically, the hardware structures of these various processors are electric circuits in which circuit elements such as semiconductor elements are combined.

Although the present exemplary embodiment has been described above, the present disclosure is not limited to the above exemplary embodiment, and various modifications, changes, and improvements may be made.

EXAMPLES

Hereinafter, examples of the present disclosure will be described, but the present disclosure is not limited to the following examples. In the following description, all "parts" and "%" are based on mass unless otherwise specified.

<Developer>

[Developer (1)]

(Synthesis of Binder Resin)

Dimethyl fumarate: 74 parts

Dimethyl terephthalate: 192 parts 2 mol adduct of bisphenol A and ethylene oxide: 216 parts 2 mol adduct of bisphenol A and propylene oxide: 48 parts Ethylene glycol: 38 parts Tetrabutoxytitanate (catalyst): 0.037 parts The above components are put into a heated and dried two-neck flask, and a nitrogen gas is introduced into the container to maintain an inert atmosphere. The temperature is increased while performing stirring, and then, a co-condensation polymerization reaction is performed at 160° C. for 7 hours. Thereafter, the temperature is increased to 220° C. while gradually reducing the pressure to 10 Torr, and the product is held at 220° C. for 4 hours. After returning to the normal pressure, 9 parts of trimellitic anhydride is added, the pressure is gradually reduced again to 10 Torr, and the thus-obtained product is held at 220° C. for 1 hour to synthesize a binder resin.

(Preparation of Resin Particle Dispersion Liquid)

Binder resin: 160 parts

Ethyl acetate: 233 parts

Sodium hydroxide aqueous solution (0.3N): 0.1 parts

The above components are put into a 1000 ml separable flask, heated at 70° C., and stirred by a three-one motor (manufactured by Shinto Scientific Co., Ltd.) to prepare a resin mixed liquid. While the resin mixed liquid is further stirred at 90 rpm, 373 parts of ion-exchange water is gradually added to the resin mixed liquid. The resin mixed liquid is subjected to phase inversion emulsification, and the solvent thereof is removed, thereby obtaining a resin particle dispersion liquid (solid content concentration: 30%). The volume average particle diameter of the resin particle dispersion liquid is 162 nm.

(Preparation of Release Agent Dispersion Liquid)

Carnauba wax (RC-160, manufactured by Toa Kasei Co., Ltd.): 50 parts

Anionic surfactant (Neogen RK, manufactured by DKS Co., Ltd.): 1.0 part

Ion-exchange water: 200 parts

The above components are mixed and heated to 95° C., and the mixture is dispersed using a homogenizer (ULTRA-TURRAX T50, manufactured by IKA Corporation) and then subjected to a dispersion treatment for 360 minutes using a Manton-Gaulin high-pressure homogenizer (manufactured by Gaulin Corporation) to prepare a release agent dispersion liquid (solid content concentration: 20%) in which release agent particles having a volume average particle diameter of 0.23 μm are dispersed.

(Preparation of Metal Pigment Particle Dispersion Liquid)

Aluminum pigment (manufactured by Showa Denko K.K., 2173EA): 100 parts

Anionic surfactant (NEOGEN R, manufactured by DKS Co., Ltd.): 1.5 parts

Ion-exchange water: 900 parts

After the solvent is removed from the paste of the aluminum pigment, the above components are mixed, dissolved, and dispersed for about 1 hour by using an emulsification disperser Cavitron (CR1010, manufactured by Pacific Machinery & Engineering Co., Ltd) to prepare a metal pigment particle dispersion liquid (solid content concentration: 10%) in which metal pigment particles (aluminum pigment) are dispersed. The average length in the long axis direction of the aluminum pigment (brilliant pigment) is 8 μm, and the average length in the thickness direction is 0.1 μm.

[Preparation of Brilliant Toner (1)]

Resin particle dispersion liquid: 380 parts

Release agent dispersion liquid: 72 parts

Metal pigment particle dispersion liquid: 140 parts

The above metal pigment particle dispersion liquid, the resin particle dispersion liquid, and the release agent dispersion liquid are put into a 2 L cylindrical stainless steel container, and are dispersed and mixed for 10 minutes while applying a shearing force at 4000 rpm by a homogenizer (ULTRA-TURRAX T50 manufactured by IKA). Next, 1.75 parts of a 10% nitric acid aqueous solution of polyaluminum chloride as an aggregating agent is gradually added dropwise, and the mixture is dispersed and mixed for 15 minutes at a rotation speed of the homogenizer of 5000 rpm to obtain a raw material dispersion liquid.

Thereafter, the raw material dispersion liquid is transferred to a polymerization vessel equipped with a thermometer and a stiffer using two paddles of stirring blades, and a stirring rotation speed is set to be 810 rpm. The raw material dispersion liquid is heated by a mantle heater to allow aggregated particles to grow at 54° C. At this time, the pH of the raw material dispersion liquid is controlled to be within the range of 2.2 to 3.5 with a 0.3N nitric acid aqueous solution or a 1N sodium hydroxide aqueous solution. The raw material dispersion liquid is held within the above pH range for about 2 hours to form aggregated particles.

Next, the resin particle dispersion liquid is further added, and the resin particles of the binder resin adhere to the surfaces of the aggregated particles. The temperature is further raised to 56° C., and the aggregated particles are arranged while confirming the size and form of the particles with an optical microscope and Multisizer II. Thereafter, in order to fuse the aggregated particles, the pH is increased to 8.0, and then the temperature is increased to 67.5° C. After the fusion of the aggregated particles is confirmed by an optical microscope, the pH is lowered to 6.0 while maintaining the temperature at 67.5° C., heating is stopped after 1 hour, and cooling and flattening are performed at a temperature decrease rate of 0.1° C./min. Thereafter, the resultant is sieved with a 20 μm mesh, repeatedly washed with water, and then dried with a vacuum dryer to obtain brilliant toner particles.

To 100 parts of the brilliant toner particles after the heat treatment, 1.5 parts of hydrophobic silica (RY50 manufactured by Nippon Aerosil Co., Ltd.) and 1.0 part of hydrophobic titanium oxide (T805 manufactured by Nippon Aerosil Co., Ltd.) are mixed using a sample mill at 10,000 rpm for 30 seconds. Thereafter, the mixture is sieved with a vibrating sieve having an opening of 45 μm to prepare a brilliant toner (1).

The average maximum thickness C of the brilliant toner particles is 4.27 μm, and the average circle-equivalent diameter D of the brilliant toner particles is 13.6 μm.

(Preparation of Carrier)

Ferrite particles (volume average particle diameter: 35 μm): 100 parts

Toluene: 14 parts

Perfluorooctyl ethyl acrylate/methyl methacrylate copolymer: 1.6 parts

Carbon black (trade name: VXC-72, manufactured by Cabot Corporation): 0.12 parts Crosslinked melamine resin particles (average particle diameter: 0.3 μm, insoluble in toluene): 0.3 parts First, carbon black is diluted with toluene and added to a perfluorooctylethyl acrylate/methyl methacrylate copolymer, followed by dispersion with a sand mill. Subsequently, the above component other than the ferrite particles is dispersed in the above mixture with a stirrer for 10 minutes to prepare a coating layer forming solution. Next, the coating layer forming solution and the ferrite particles are put into a vacuum degassing kneader, stirred at a temperature of 60° C. for 30 minutes, and then the pressure is reduced to distill off the toluene, thereby forming a resin coating layer to obtain a carrier.

(Preparation of Developer)

36 parts of the brilliant toner and 414 parts of the carrier are put into a 2 liter V-blender, stirred for 20 minutes, and then sieved with a sieve having a diameter of 212 μm to prepare the developer.

[Developer (2)]

A binder resin is synthesized as follows.

Dimethyl fumarate: 87 parts

Dimethyl terephthalate: 192 parts 2 mol adduct of bisphenol A and ethylene oxide: 216 parts 2 mol adduct of bisphenol A and propylene oxide: 48 parts Tetrabutoxytitanate (catalyst): 0.037 parts The above components are put into a heated and dried two-neck flask, and a nitrogen gas is introduced into the container to maintain an inert atmosphere. The temperature is increased while performing stirring, and then, a co-condensation polymerization reaction is performed at 160° C. for 7 hours. Thereafter, the temperature is increased to 220° C. while gradually reducing the pressure to 10 Torr, and the product is held at 220° C. for 4 hours. After returning to the normal pressure, the pressure is gradually reduced again to 10 Torr, and the thus-obtained product is held at 220° C. for 1 hour to synthesize a binder resin.

A brilliant toner (2) is obtained in the same manner as in the preparation of the brilliant toner (1) except that the obtained binder resin is used.

A developer (2) is obtained in the same manner as in the preparation of the developer (1) except that the obtained brilliant toner (2) is used.

The average maximum thickness C of the brilliant toner particles is 1.95 μm, and the average circle-equivalent diameter D of the brilliant toner particles is 15.6 μm.

[Developer (3)]

A binder resin is obtained in the same manner as in the synthesis of the binder resin in the preparation of the brilliant toner (1) except that 82 parts of dimethyl adipate are used instead of 74 parts of dimethyl fumarate.

A brilliant toner (3) is obtained in the same manner as in the preparation of the brilliant toner (1) except that the obtained binder resin is used.

A developer (3) is obtained in the same manner as in the preparation of the developer (1) except that the obtained brilliant toner (3) is used.

The average maximum thickness C of the brilliant toner is 1.133 μm, and the average circle-equivalent diameter D of the brilliant toner particles is 10.3 μm.

[Developer (4)]

A binder resin is obtained in the same manner as in the synthesis of the binder resin in the preparation of the brilliant toner (1) except that 82 parts of dimethyl adipate are used instead of 74 parts of dimethyl fumarate, the number of parts of the 2 mol adduct of bisphenol A and propylene oxide is 147 parts instead of 48 parts, and trimellitic anhydride is not used.

A brilliant toner (4) is obtained in the same manner as in the preparation of the brilliant toner (1) except that the obtained binder resin is used.

A developer (4) is obtained in the same manner as in the preparation of the developer (1) except that the obtained brilliant toner (4) is used.

The average maximum thickness C of the brilliant toner particles is 2.22 μm, and the average circle-equivalent diameter D of the brilliant toner particles is 5.4 μm.

[Developer (5)]

A binder resin is obtained in the same manner as in the synthesis of the binder resin in the preparation of the brilliant toner (1) except that 82 parts of dimethyl adipate are used instead of 74 parts of dimethyl fumarate, the number of parts of the 2 mol adduct of bisphenol A and propylene oxide is 147 parts instead of 48 parts, and the number of parts of trimellitic anhydride is 12 parts instead of 9 parts.

A brilliant toner (5) is obtained in the same manner as in the preparation of the brilliant toner (1) except that the obtained binder resin is used. However, the brilliant toner (5) is obtained by adjusting the viscosity at 130° C. to the values shown in Table 1.

A developer (5) is obtained in the same manner as in the preparation of the developer (1) except that the obtained brilliant toner (5) is used.

The average maximum thickness C of the brilliant toner particles is 4.27 μm, and the average circle-equivalent diameter D of the brilliant toner particles is 8.1 μm.

Examples 1 to 26 and Comparative Examples 1 and 2

The developer shown in Table 1 is filled in a developing device for forming a brilliant image of an image forming apparatus "Versant 3100iPress" (manufactured by Fuji Xerox Co., Ltd.) modified machine (modified machine including a fixing device having the same configuration as the fixing device shown in FIG. 3). Here, the configuration of the fixing device is set as shown in Table 1.

The shape of a nip in a fixing device shown in Example 26 is substantially flat and slightly curved.

Then, the following evaluation is performed using the image forming apparatus.

(Evaluation of Brilliance)

Using the image forming apparatus of each example, 20 brilliant solid images having a size of 5 cm×5 cm and having a loading amount of the brilliant toner of 3.5 g/m$^2$ are output on OK top coat paper (basis weight 127: manufactured by Oji Paper Co., Ltd.).

For the 20th brilliant solid image, a spectral variable angle color difference meter GC5000L manufactured by Nippon Denshoku Industries Co., Ltd. is used as a goniophotometer to measure a reflectance X at a light receiving angle of +30° and a reflectance Y at a light receiving angle of −30° after incident light with an incident angle of −45° is incident onto the solid image. The reflectance X and the reflectance Y are measured with the light, which has a wavelength within a range from 400 nm to 700 nm, at intervals of 20 nm, and are average values of the reflectance at respective wavelengths.

The ratio (X/Y) is calculated based on these measurement results and the brilliance is evaluated according to the following evaluation criteria.

The higher the ratio (X/Y) is, the higher the brilliance is, and the lower the ratio (X/Y) is, the stronger the feeling of dullness is and the less the brilliance is.

A: The ratio (X/Y) is 80 or more and 100 or less.

B: The ratio (X/Y) is 60 or more and less than 80.

C: The ratio (X/Y) is 2 or more and less than 60.

D: The ratio (X/Y) is less than 2.

TABLE 1

| | Developer | | | | | |
|---|---|---|---|---|---|---|
| | | Properties of brilliant toner | | | | |
| | | Ratio of average | | Fixing device | | |
| | Kind | maximum thickness C to average circle-equivalent diameter D (C/D) | Viscosity at 130° C. (Pa · s) | Fixing temperature (° C.) | Shape of nip portion | Linear velocity of fixing belt (mm/sec) |
| Example 1 | Developer 1 | 0.314 | 550 | 180 | Flat | 400 |
| Example 2 | Developer 1 | 0.314 | 550 | 170 | Flat | 400 |
| Example 3 | Developer 1 | 0.314 | 550 | 180 | Flat | 420 |
| Example 4 | Developer 1 | 0.314 | 550 | 180 | Flat | 400 |
| Example 5 | Developer 1 | 0.314 | 550 | 180 | Flat | 420 |
| Example 6 | Developer 1 | 0.314 | 550 | 130 | Flat | 400 |
| Example 7 | Developer 1 | 0.314 | 550 | 230 | Flat | 400 |
| Example 8 | Developer 1 | 0.314 | 550 | 180 | Flat | 160 |
| Example 9 | Developer 1 | 0.314 | 550 | 180 | Flat | 180 |
| Example 10 | Developer 1 | 0.314 | 550 | 180 | Flat | 450 |
| Example 11 | Developer 1 | 0.314 | 550 | 180 | Flat | 470 |
| Example 12 | Developer 1 | 0.314 | 550 | 180 | Flat | 400 |
| Example 13 | Developer 1 | 0.314 | 550 | 180 | Flat | 400 |
| Example 14 | Developer 1 | 0.314 | 550 | 180 | Flat | 400 |
| Example 15 | Developer 1 | 0.314 | 550 | 180 | Flat | 400 |
| Example 16 | Developer 1 | 0.314 | 550 | 180 | Flat | 400 |
| Example 17 | Developer 1 | 0.314 | 550 | 180 | Flat | 400 |
| Example 18 | Developer 1 | 0.314 | 550 | 180 | Flat | 400 |
| Example 19 | Developer 1 | 0.314 | 550 | 180 | Flat | 400 |
| Example 20 | Developer 1 | 0.314 | 550 | 180 | Flat | 400 |
| Example 21 | Developer 2 | 0.125 | 94 | 180 | Flat | 400 |
| Example 22 | Developer 3 | 0.11 | 106 | 180 | Flat | 400 |
| Example 23 | Developer 4 | 0.421 | 995 | 180 | Flat | 400 |
| Example 24 | Developer 5 | 0.528 | 1100 | 180 | Flat | 400 |
| Example 25 | Developer 1 | 0.314 | 550 | 180 | Curved | 400 |
| Example 26 | Developer 1 | 0.314 | 550 | 180 | Curved | 400 |
| Comparative Example 1 | Developer 1 | 0.314 | 550 | 120 | Flat | 400 |
| Comparative Example 2 | Developer 1 | 0.314 | 550 | 240 | Flat | 400 |

| | Fixing device | | | | | |
|---|---|---|---|---|---|---|
| | Surface hardness A of fixing roller (°) | Surface hardness B of pressure roller (°) | Difference in surface hardness of rollers (A − B) (°) | Pressure on nip portion (kgf/cm$^2$) | Number of carbon atoms | Evaluation of Brilliance |
| Example 1 | 40 | 40 | 0 | 5.5 | 1.1 | A |
| Example 2 | 40 | 40 | 0 | 5.5 | 1.1 | A |

TABLE 1-continued

| | | | | | | |
|---|---|---|---|---|---|---|
| Example 3 | 40 | 40 | 0 | 5.5 | 1.1 | A |
| Example 4 | 40 | 45 | 5 | 5.5 | 1.1 | A |
| Example 5 | 40 | 40 | 0 | 5 | 1.1 | A |
| Example 6 | 40 | 40 | 0 | 5.5 | 1.1 | B |
| Example 7 | 40 | 40 | 0 | 5.5 | 1.1 | B |
| Example 8 | 40 | 40 | 0 | 5.5 | 1.1 | C |
| Example 9 | 40 | 40 | 0 | 5.5 | 1.1 | B |
| Example 10 | 40 | 40 | 0 | 5.5 | 1.1 | B |
| Example 11 | 40 | 40 | 0 | 5.5 | 1.1 | C |
| Example 12 | 35 | 50 | 15 | 5.5 | 1.1 | B |
| Example 13 | 35 | 40 | 5 | 5.5 | 1.1 | B |
| Example 14 | 45 | 40 | 5 | 5.5 | 1.1 | B |
| Example 15 | 40 | 40 | 0 | 5.5 | 1.1 | B |
| Example 16 | 40 | 50 | 10 | 5.5 | 1.1 | B |
| Example 17 | 40 | 40 | 0 | 4 | 1.1 | B |
| Example 18 | 40 | 40 | 0 | 7 | 1.1 | B |
| Example 19 | 40 | 40 | 0 | 5.5 | 0.9 | B |
| Example 20 | 40 | 40 | 0 | 5.5 | 1.3 | B |
| Example 21 | 40 | 40 | 0 | 5.5 | 1.1 | C |
| Example 22 | 40 | 40 | 0 | 5.5 | 1.1 | B |
| Example 23 | 40 | 40 | 0 | 5.5 | 1.1 | B |
| Example 24 | 40 | 40 | 0 | 5.5 | 1.1 | C |
| Example 25 | 30 | 55 | 25 | 5.5 | 1.1 | B |
| Example 26 | 40 | 40 | 0 | 5.5 | 1.5 | B |
| Comparative Example 1 | 40 | 40 | 0 | 5.5 | 1.1 | D |
| Comparative Example 2 | 40 | 40 | 0 | 5.5 | 1.1 | D |

From the above results, it can be seen that in the present examples, a brilliant image with a high brilliance formed of the brilliant toner may be formed as compared with the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A unit comprising:

a developing device configured to develop an electrostatic charge image that is formed on a surface of an image carrier, as a toner image with a developer including a brilliant toner containing a flat brilliant pigment, the developer being accommodated in the developing device; and a fixing device configured to fix the toner image onto a surface of a recording medium at a fixing temperature of 130° C. or higher and 230° C. or lower that comprises a fixing belt, a first roller and a second roller that are disposed inside the fixing belt and support the fixing belt while applying tension to the fixing belt, and a pressure roller, the first roller and the pressure roller sandwiching the fixing belt to form a nip portion, wherein an absolute value of a difference between a surface hardness of the first roller and a surface hardness of the pressure roller is within 15°.

2. The unit according to claim 1, wherein the nip portion is flat.

3. The unit according to claim 1, wherein the fixing belt is rotationally driven at a linear velocity of 180 mm/sec or more and 450 mm/sec or less.

4. The unit according to claim 2, wherein the surface hardness of the first roller is 35° or more and 45° or less.

5. The unit according to claim 2, wherein the fixing belt is rotationally driven at a linear velocity of 180 mm/sec or more and 450 mm/sec or less.

6. The unit according to claim 3, wherein the surface hardness of the first roller is 35° or more and 45° or less.

7. The unit according to claim 1, wherein an absolute value of a difference between a surface hardness of the first roller and a surface hardness of the pressure roller is within 10°.

8. The unit according to claim 1, wherein an absolute value of a difference between a surface hardness of the first roller and a surface hardness of the pressure roller is within 5°.

9. The unit according to claim 1, wherein an absolute value of a difference between a surface hardness of the first roller and a surface hardness of the pressure roller is 0°.

10. The unit according to claim 1, wherein the surface hardness of the first roller is 35° or more and 45° or less.

11. The unit according to claim 1, wherein the surface hardness of the pressure roller is 40° or more and 50° or less.

12. The unit according to claim 5 claim 1, wherein a pressure on the nip portion is 2.0 kgf/cm$^2$ or more and 7.0 kgf/cm$^2$ or less.

13. The unit according to claim 1, wherein a pressure on the nip portion is 4.0 kgf/cm$^2$ or more and 7.0 kgf/cm$^2$ or less.

14. The unit according to claim 1, wherein an outer diameter ratio of the first roller to the pressure roller is 0.9 or more and 1.3 or less.

15. The unit according to claim 1, wherein the brilliant toner has a viscosity at 130° C. of 100 Pa·s or more and 1000 Pa·s or less.

16. The unit according to claim 1, wherein the brilliant toner comprises brilliant toner particles, and a ratio C/D of an average maximum thickness C of the brilliant toner particles to an average circle-equivalent diameter D of the brilliant toner particles is within a range of 0.001 or more and 0.700 or less.

17. An image forming apparatus comprising:

a toner image forming device that comprises an image carrier and a developing device configured to develop an electrostatic charge image that is formed on a surface of the image carrier, as a toner image with a developer including a brilliant toner containing a flat brilliant pigment, the developer being accommodated in the developing device;

a transfer device configured to transfer the toner image formed on the surface of the image carrier to a surface of a recording medium; and a fixing device configured to fix the toner image onto the surface of the recording medium at a fixing temperature of 130° C. or higher and 230° C. or lower that comprises a fixing belt, a first roller and a second roller that are disposed inside the fixing belt and support the fixing belt while applying tension to the fixing belt, and a pressure roller, the first roller and the pressure roller sandwiching the fixing belt to form a nip portion, wherein an absolute value of a difference between a surface hardness of the first roller and a surface hardness of the pressure roller is within 15°.

18. The unit according to claim 17, wherein an absolute value of a difference between a surface hardness of the first roller and a surface hardness of the pressure roller is within 10°.

19. The unit according to claim 17, wherein the surface hardness of the first roller is 35° or more and 45° or less.

* * * * *